US008167088B2

(12) United States Patent
Kuhlman

(10) Patent No.: US 8,167,088 B2
(45) Date of Patent: May 1, 2012

(54) LADDER CAP LIGHT

(76) Inventor: Steve Kuhlman, Everett, WA (US)

( * ) Notice: Subject to any disclaimer, the term of this patent is extended or adjusted under 35 U.S.C. 154(b) by 1108 days.

(21) Appl. No.: 11/966,683

(22) Filed: Dec. 28, 2007

(65) Prior Publication Data

US 2009/0166128 A1 Jul. 2, 2009

(51) Int. Cl.
*E06C 7/48* (2006.01)

(52) U.S. Cl. ..... 182/129; 182/108

(58) Field of Classification Search ..... 182/108, 182/129; 362/109
See application file for complete search history.

(56) References Cited

U.S. PATENT DOCUMENTS 3,692,145 A 9/1972 Banner
4,090,185 A * 5/1978 Patty ..... 340/321
4,395,696 A * 7/1983 Menard ..... 340/431
4,766,525 A 8/1988 Loughlin
4,771,862 A * 9/1988 Garland ..... 182/108
5,109,322 A 4/1992 Loughlin
D342,460 S 12/1993 Loughlin
D342,913 S 1/1994 Loughlin
5,825,280 A 10/1998 Merendini et al.
5,908,082 A 6/1999 Turner et al.
6,443,260 B1 9/2002 Katz et al.
6,755,258 B1 6/2004 Hunke et al.
6,864,799 B2 3/2005 Popps et al.
6,966,403 B1 * 11/2005 Chandra ..... 182/18
8,015,737 B2 * 9/2011 Venegas, Jr. ..... 40/607.03

* cited by examiner

*Primary Examiner* — Alvin Chin Shue
(74) *Attorney, Agent, or Firm* — Dwayne E. Rogge; Schacht Law Office, Inc.

(57) ABSTRACT

A ladder attachment configured to attach to a lateral member of the ladder at the upper portion. The ladder attachment has an illuminating portion providing light which can be utilized to identify the location of a ladder in, for example, an emergency situation.

6 Claims, 5 Drawing Sheets

LADDER CAP LIGHT

BACKGROUND OF THE DISCLOSURE

Ladders are utilized in various capacities for common maintenance upon buildings as well as in emergency situations for ascending upon structures or providing alternative escape routes therefrom.

Ladders are a common means for providing access to upper regions of various structures and of course are well-known in the art. In emergency-type situations, such as use by fire and police, ladders are utilized for ascending structures in often adverse circumstances.

In the case of a fire in a building or other structure, it is normal practice within the discipline of firefighting to provide alternative escape routes from buildings. One form of an alternative escape route is to provide a ladder at a perimeter region of a building. During a fire smoke is emitted, and due to the continually fluid nature of unpredictable events the environment may be very stressful and chaotic. Oftentimes the adverse circumstances can impede the senses when determining the location of a ladder. Whether the ladder is utilized as a primary means of embarking upon the building or as a backup exit strategy, knowledge of the location of the ladder is imperative.

Over the years the fire service has increased safety standards substantially and is continuing to come up with new ideas to help keep firefighters healthy. Often firefighters must carry out their duties in the midst of darkness and visibility is often low due to smoke conditions. In any structure fire situation, there are multiple ladders either going to the roof so crews can perform ladder company operations, or ladders extend to exterior windows so crews inside have emergency egress routes.

Oftentimes firefighters ascending to the roof will put a ladder up to gain access and begin performing their assigned duties while relying on other personnel to set up secondary means of egress. This is very time efficient, but unfortunately crews can become disoriented under smoky conditions and may not be able to visualize egress routes due to certain fire situations.

Engine and ladder companies may be inside the structure fighting fire and performing search and rescue operations while ventilation is being performed on the roof. These crews must also be aware of their egress routes for victim removal and emergency exit. Often heavy dark smoke will not allow crews to see the exterior windows where ladders have been placed for them, and at times radio traffic can be unclear when relaying commands to interior crews.

In such a circumstance where smoke emission is excessive, it is most desirable to locate the ladder by way of visual cues.

Therefore, providing a ladder with an illuminating beacon or otherwise illuminating portion to aid in the location of the ladder can be of great use in emergency situations as well as other circumstances. In other forms, the illuminating portion of the ladder cap can provide functional illumination of a surrounding such that in one form, an illuminating region is projecting a light to illuminate immediate surroundings upon the end portion of the ladder.

SUMMARY OF THE DISCLOSURE

Disclosed herein is one form of a ladder cap configured to attach to a lateral member of a ladder having an upper attachment location. The ladder has in a frame that provides a shield defining a central region. A surface defining an open region in the frame further comprising an attachment member configured to attach the ladder to the upper attachment location of the ladder.

An illuminating member is provided and configured to fit in the central region of the protective shield. The illuminating member has an illuminating portion which corresponds in location to the open region of the protective shroud.

The illumination portion is configured to project light through the open region of the protective shroud for various potential purposes.

In one form switch mechanism is positioned on the illuminating member and the switch mechanism is a push button switch positioned on a laterally inward surface of the illuminating member.

The upper attachment location can be configured to provide an interior channel where the attachment member is further joined with a second attachment member to fixedly attach the ladder cap to the upper attachment location. The illuminating member can be attached to the frame by way of fasteners and is fixedly and removably attached thereto. The illuminating member in form is configured to be removed from the frame by removing the fasteners which are threaded members configured to be mounted to interior frame members of the frame member.

The ladder cap can have a first and second interior frame legs that are positioned at an oblique orientation with respect to a longitudinal axis of the ladder cap thereby providing structural support to an exterior semi-circular portion of the frame.

Other forms of carrying out the embodiments and methods are disclosed herein.

DESCRIPTION OF THE PREFERRED EMBODIMENTS

Figure 1:
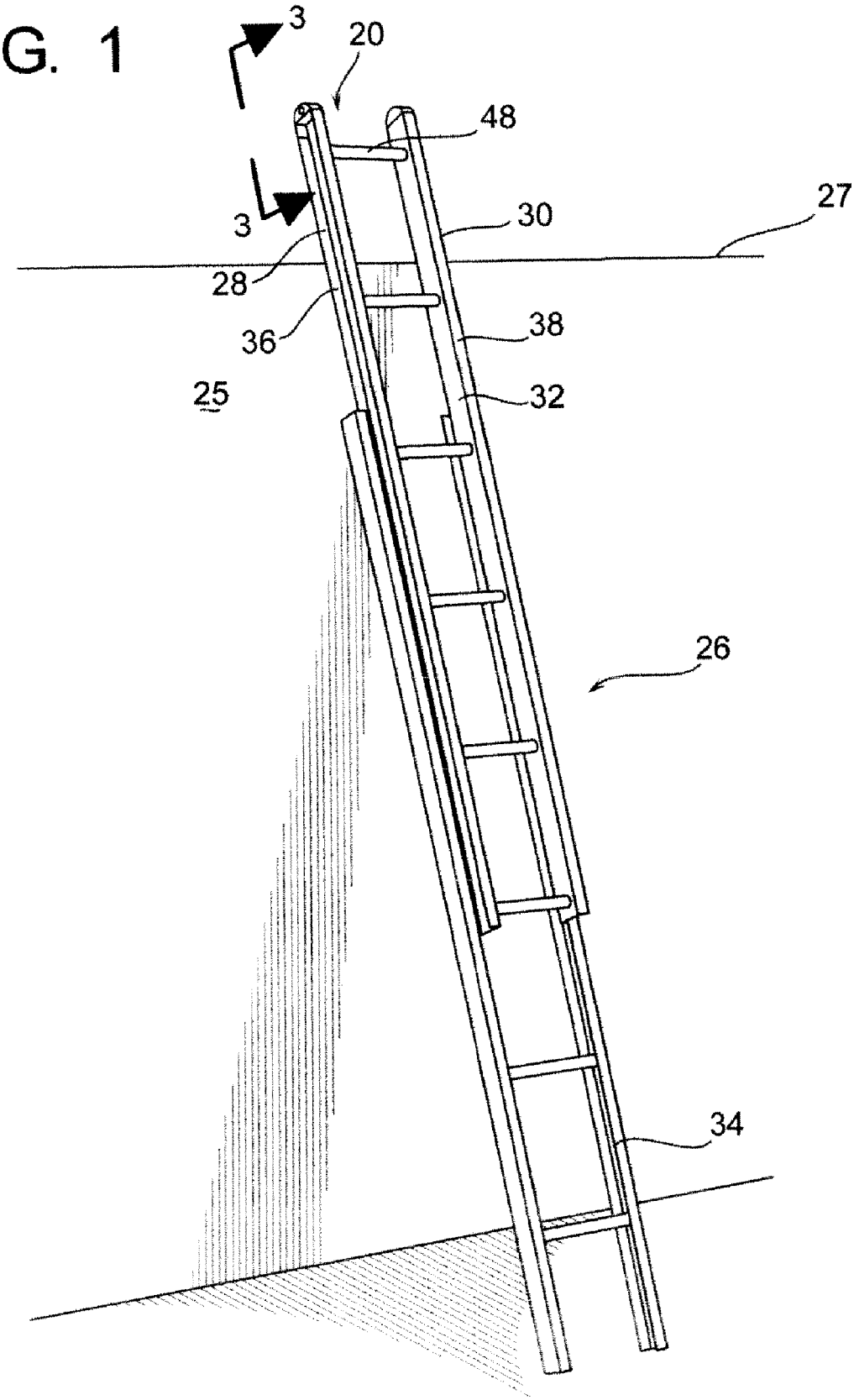
FIG. 1 shows a ladder having first and second lateral portions and a plurality of rungs positioned adjacent to a structure.
Figure 4:
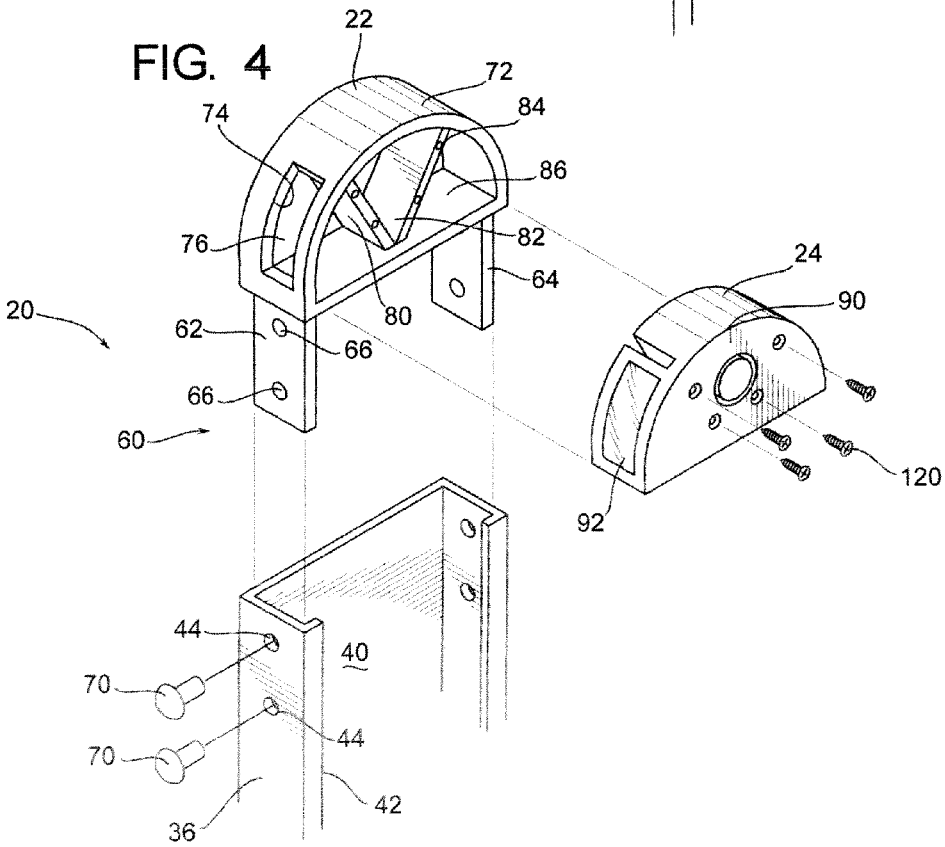
FIG. 4 shows a partially exploded view where the frame member is positioned above an upper attachment portion of the ladder and an illuminating member insert is positioned adjacent to the frame member.
Figure 5:
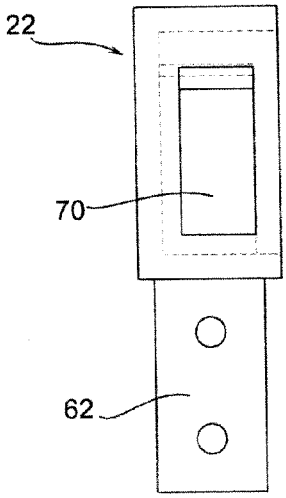
FIG. 5 shows a transverse view of the frame member with a surface defining an open region to provide a protective access port for the illuminating portion of the illuminating member.

As described herein, there is a ladder attachment otherwise referred to as a ladder cap which is configured to attach to a lateral structural member of a ladder. As shown in FIG. 1, there is an environmental view where the ladder attachment 20 is shown attached to a ladder 26. As shown in FIG. 4, the ladder attachment 20 in one form is comprised of a frame 22 and a illuminating member 24.

Figure 2:
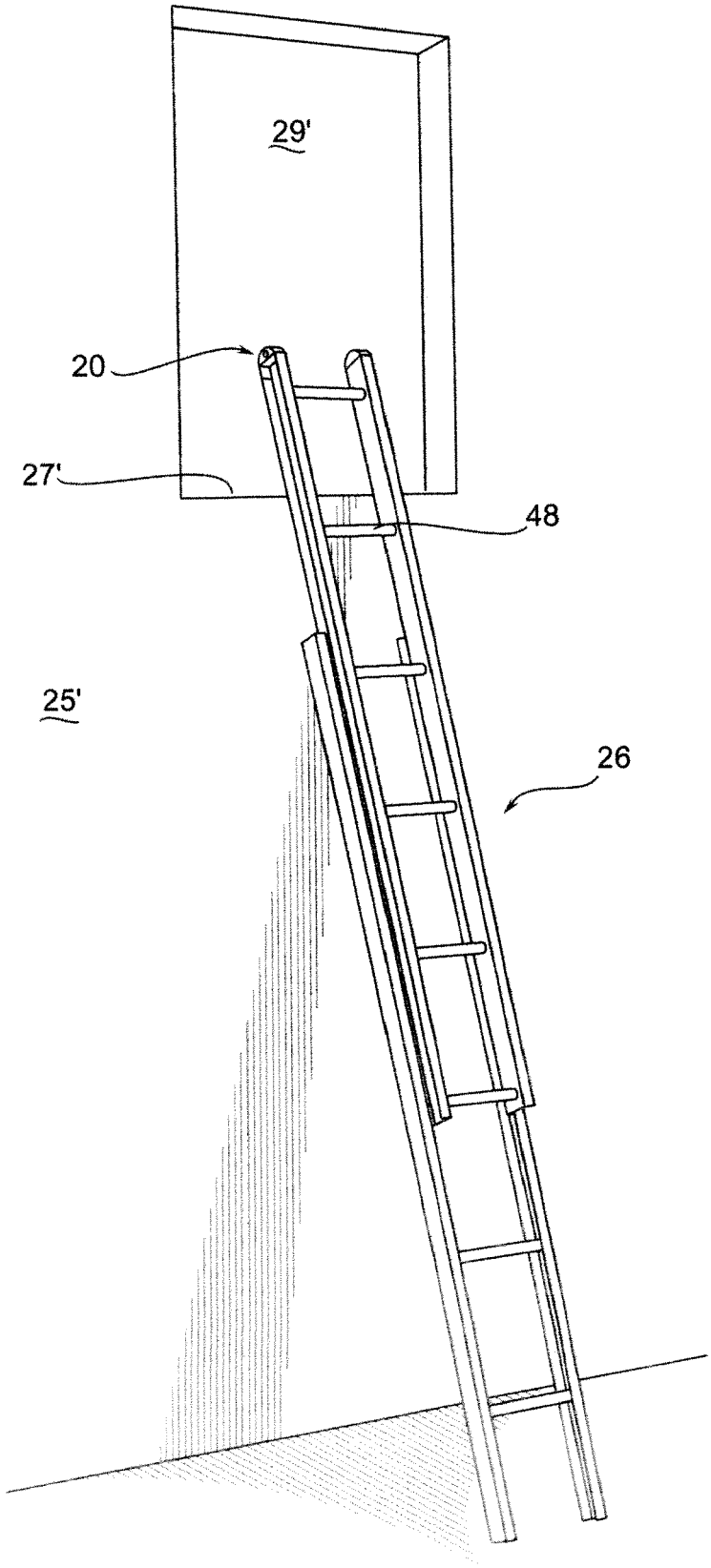
FIG. 2 shows a ladder positioned adjacent to a structure such as a building with an upper open region which in one form could be a window.

There will first be a description of an axis system, followed by a general description of the operating environment with reference to FIGS. 1 and 2. Thereafter, there will be a detailed description of one form of the ladder attachment member 20 describing one way of carrying out the concept, though of course it should be understood that other methods of carrying out the ladder attachment can also be employed, such as combining elements or having the elements in two different components or a different locations, such as the battery supply.

Figure 3:
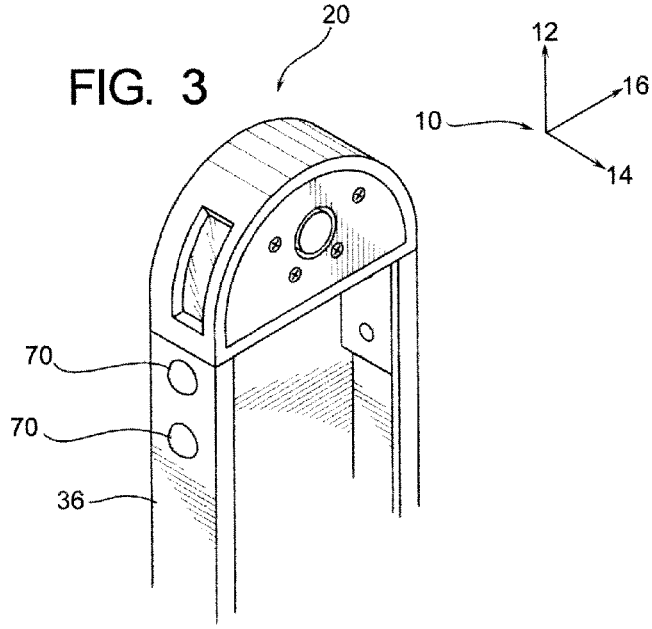
FIG. 3 is a close-up isometric view of the ladder cap.

As shown in FIG. 3, there is a axes system 10 which shows a longitudinal axes 12 which points to a vertical direction when the ladder 26 is aligned vertically. Further, there is a lateral axis 14 which in the case of FIG. 3 points to a laterally inward direction. Further, there is a transverse axis 16 which points towards a forward or first direction, and the opposing direction is referred to as a second transverse direction or a rearward transverse direction for purposes of description.

Referring now back to FIGS. 1 and 2, there are shown various examples of an operating environment for a ladder 26. In general, ladders can come in many forms and are well-known in the art. For purposes of description, a ladder is generally defined as having first and second lateral portions 28 and 30. In one form, the lateral portions are comprised of two members as shown in the figures, including an upper member 32 and a lower member 34. As is well known in the art, the upper member can extend in a telescopic-like fashion to accommodate the varying heights of various structures 25.

Referring to the upper member 32, the first and second lateral portions 28 and 30 more specifically comprise lateral members 36 and 38. As shown in FIG. 4, in one form the lateral members (such as the first lateral member 36) are configured to have an inner surface 40 which defines an inner channel 42. In one form, it is conventional to have the surfaces 44, which define openings, to have an attachment fixture attached to the upper portion thereof. Prior art types of attachment fixtures are provided to absorb impact and generally protect the end region of the ladder, or otherwise provide a rounded end portion so as not to provide an incising surface, such a sharp corner, which can pose a hazard of individuals or equipment.

Referring now back to FIG. 1, it can be appreciated that the first lateral member 36 and second lateral member 38 have a plurality of rung members 48 positioned therebetween at spaced intervals for climbing thereupon.

FIG. 1 shows one type of an operating environment where the structure 25 has an upper edge portion 27 for positioning the ladder thereupon.

The structure 25, for example, may be a wall or an edge portion of the building, such as a flat roof building, and the ladder 26 could provide a secondary escape exit from the structure which may be in peril by way of a fire or the like. As noted in a previous section of this application, it is common protocol in emergency situations to position a ladder as an alternative escape or a primary escape from a structure. In such a situation the structure may actually be on fire, at risk of catching on fire, or perhaps be in some state of emergency, such as a chemical leak or the like.

It can be appreciated how the upper portion of the ladder in one form extends beyond the upper edge portion 27 of the structure 25. In a similar manner as shown in FIG. 2, the ladder 26 is positioned adjacent to a structure 25' which is provided with an upper sill surface 27'. In either of the situations, as shown in FIG. 1 or FIG. 2, it can be advantageous to provide a system and method for identifying the location of the ladder in adverse circumstances, such as a fire which produces smoke. Oftentimes smoke can impede visual line of sight, and the stress of an emergency situation can impede cognitive awareness of where the ladder is located. Further, when working in teams, it may not be apparent where another team member positioned the ladder to be used as a backup escape route. As shown in FIG. 2, the interior region 29' of the structure 25' could be a dark enclosure. In such emergency situations, it is not uncommon for electricity to be terminated, or illuminating devices such as interior lighting may be destroyed or inoperable. Further, as noted above, the smoke can impede visible light. Therefore, there is not only a need for identifying the location of the ladder, but further for providing illumination from the ladder to an interior region 29' as shown in FIG. 2. The ladder attachment 20 provides this illumination.

With reference to FIG. 3, there will now be a more detailed description of one form of a ladder attachment 20. FIG. 3 shows the ladder attachment 20 attached to a lateral member 36 of a ladder. It should be noted in one form that the ladder attachment 20 can be integral with the lateral member 36, or attached by way of fasteners 70. Further, in one form, the ladder attachment 20 can be provided as an OEM addition to a ladder directly from the manufacturer, or can be retrofitted to existing ladders in the field.

As shown in FIG. 4, the partially exploded view shows one form of carrying out the concept where the frame member 22 is positioned above the lateral member 36 of the ladder. The frame member 22 comprises an attachment region 60 which in one form comprises first and second attachment members 62 and 64. The attachment members 62 and 64 comprise the surfaces 66 defining openings which correspond in location to the surfaces defining openings 44 of the lateral member 36 wherein fasteners 70, such as screws or snap rivets, can be utilized to fixedly attach the frame member to the lateral member of the ladder. It should be noted that the lateral member 36 is a structural member which is configured to bear a load thereon, as well as having a variety of different moments exerted thereupon. In other forms the attachment region 60 could be adhesively attached, frictionally attached, or attached by other mechanisms to incorporate the illuminating portion 92 with the ladder. In other forms, the ladder attachment 20 could be removably attached to the ladder by way of, for example, a quick-release system so as to use the ladder attachment apart from the ladder in a situation where it would be needed as an emergency lighting device.

The frame member 22 in one form further comprises a protective shield 72 which is a semicircular structure. As shown in the left-hand portion of FIG. 4, there is a surface 74 defining the open region 76. As described herein, the open region can be provided for allowing access of the illuminating member 92 described herein with reference to the illuminating member 24. The open region 76 can be a totally open region or provided with a transparent member positioned thereupon.

The frame member in one form further comprises first and second interior frame legs 80 and 82.

Positioned on the interior frame legs 80 and 82 are connection locations 84, which in one form are female threaded surfaces configured to hold the fasteners 120.

Figure 11:
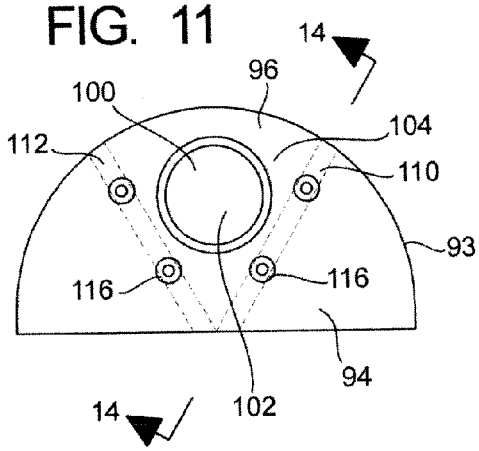
FIG. 11 shows a side view of the illuminating member.
Figure 12:
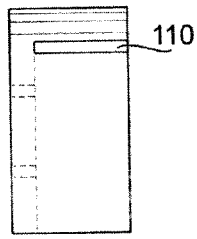
FIG. 12 shows an opposing transverse view of the insert as opposed at an opposite direction of FIG. 10.
Figure 13:
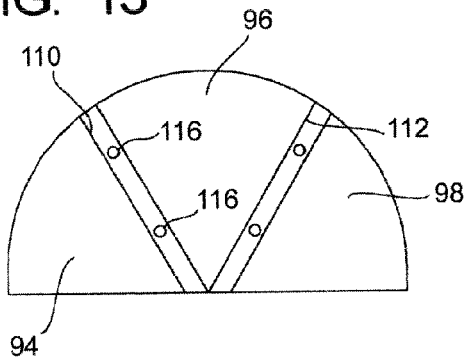
FIG. 13 shows a opposing side view of the illuminating member.
Figure 14:
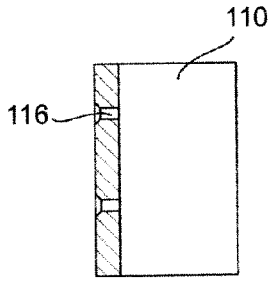
FIG. 14 shows a sectional view taken along line 14-14 of FIG. 11.

In general, the frame has an interior surface defining the central region 86. Referring to the right-hand portion of FIG. 4, there is an illuminating member 24. In one form, the illuminating member 24 is an illuminating insert member which is configured to fit substantially within the chamber region 86 of the frame 22. In one form the illuminating member 24 has an exterior surface 90 which is semicircular and configured to fit within the interior surface of the central region 86 of the frame 22. The illuminating portion 92 can be a conventional lighting source, such as an LED light or other type of illuminating source. The illuminating member further can be provided with a battery source which could be provided in either of the sections 94, 96 and/or 98 as shown in FIG. 13. As shown in FIG. 11, a switch mechanism 100 is provided which could be a push-button switch. The unit can be rechargeable with a plug and recharger, such as a 12 v DC internal charger or other type of charging mechanism. Further, there interchangeable batteries could be utilized and could be swapped out and placed in a charging unit. In one form the outer surface 102 can extend beyond the adjacent surface 104 so as to be easily depressed by an individual wearing protective gloves, or otherwise the surface 102 can be recessed to ensure the light stays on when individuals are using the ladder.

Figure 6:
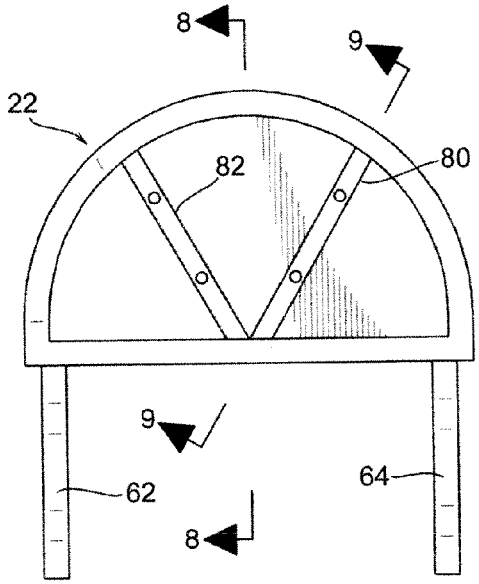
FIG. 6 is a side view of the frame member.
Figure 7:
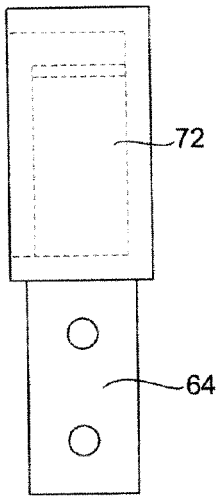
FIG. 7 shows an opposing transverse view of the frame member opposite of the view taken at FIG. 5.
Figure 8:
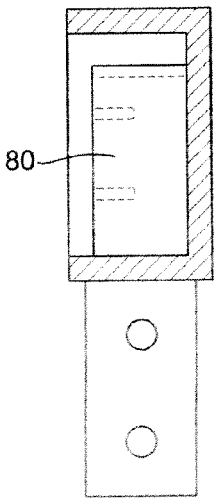
FIG. 8 shows a sectional view taken at line 8-8 of FIG. 6 showing the interior central region of a frame member and a portion of the Interior frame leg.
Figure 9:
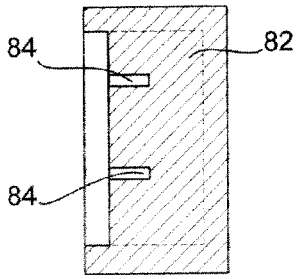
FIG. 9 is a sectional view along one of the interior frame legs.
Figure 10:
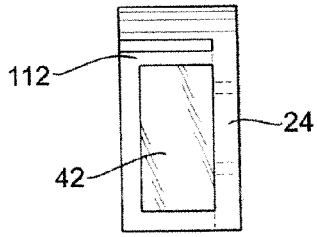
FIG. 10 shows a transverse view of the illuminating member showing the illuminating portion.

As shown in FIG. 13, between sections 94, 96 and 98 there is a region 110 and 112 which is configured to fit there around the interior frame legs 80 and 82 as shown in FIG. 6. The surfaces defining openings 116 as shown in FIGS. 11 and 13 are provided to allow the fasteners 120 as shown in FIG. 4 to pass therethrough and engage the connection locations 84 as shown in FIG. 4. In one form, the fasteners 120 are conventional screws which could be the design of wood screws and be designed to incise threads within the surfaces defined the openings 84 of the frame member.

Figure 15:
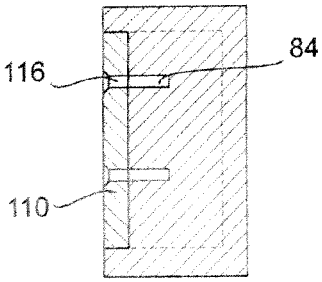
FIG. 15 shows a sectional view of a cross-sectional profile similar to that shown by sectional lines 14-14 of FIG. 11 and sectional lines 9-9 of FIG. 6 where the illuminating member is positioned upon the frame member.

As shown in FIG. 15, the openings 116 are configured to coincide in alignment with the connection locations 84 wherein the illuminating member could be an insert member which is replaceable or otherwise fixedly and removably attached thereto.

Of course, it can be appreciated that the above detailed description is only one form of carrying out the concept, and a multitude of other forms can be executed. For example, the insert member could be integral with the frame member. Alternatively, the illuminating portion 92 can be reciprocated on the opposing section 94, as shown in FIG. 11 where the area indicated at 93 can be further provided with an illuminating portion. One form of attaching an illuminating insert member to the frame is by way of attachment to the interior frame legs. But of course a multitude of attachment mechanisms can be utilized.

The internal control system in one form can be configured whereby the illuminating portion 92 can provide a plurality of different types of illuminating protocols. For example, one illuminating scheme could be a constant light and another could be a blinking light where a conventional capacitor can be utilized to charge up and provide a high intensity high lumen output. Further, other illuminating forms can be utilized, such as a progressive dim-to-bright lighting mechanism. Further, the one-button can function as the interface to cycle through the lights or a plurality of button like interface members could be utilized.

There can also be an internal switch that has a mercury or other type of gravitational switch whereby when the ladder is orientated in a more vertical than horizontal orientation, the light will automatically turn on.

As a further enhancement, there could be a low battery indicator on the unit, such as a small LED which indicates when the battery is at a lower charge level having a limited life capacity remaining. Because the ladders or designed for emergency situations, such indicator can be useful to a fireman or individual in the maintenance area of a fire department to ensure that the units are sufficiently charged for functionality when deployed.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A ladder cap configured to attach to a lateral member of a ladder having an upper attachment location, the ladder cap comprising:

a) a frame providing a protective shield defining a central region, a surface defining an open region, the frame further comprising an attachment member configured to attach the ladder cap to the upper attachment location of the ladder, b) a self powered illuminating member positioned within the central region of the protective shield and protected thereby, the illuminating member having an illuminating portion which corresponds in location to the open region of the protective shroud, c) wherein the illuminating portion is configured to project light through the open region of the protective shield, wherein the ladder comprises a pair of rails connected by rungs and the lateral member being one of said rails, where the upper attachment location comprises an interior channel, wherein the ladder cap comprise an attachment member extending into the channel fixedly attaching the ladder cap to the upper attachment location of the ladder.

2. The ladder cap as recited in claim 1 further comprising a switch mechanism positioned on the illuminating member.

3. The ladder cap as recited in claim 2 wherein the switch mechanism is a push button switch positioned on a laterally inward surface of the illuminating member.

4. The ladder cap as recited in claim 1 where the illuminating member is attached to the frame by way of fasteners and is fixedly and removably attached thereto.

5. The ladder cap as recited in claim 4 where the illuminating member is configured to be removed from the frame by removing the fasteners which are threaded members configured to be mounted to interior frame members of the frame member.

6. The ladder cap as recited in the claim 1 where first and second interior frame legs are positioned at an oblique orientation with respect to a longitudinal axis of the ladder cap thereby providing structural support to an exterior semi-circular portion of the frame.

* * * * *